US007331486B2

(12) United States Patent
Mon et al.

(10) Patent No.: US 7,331,486 B2
(45) Date of Patent: Feb. 19, 2008

(54) PUMP DISPENSER AND CARTRIDGE

(75) Inventors: Thomas K. Mon, Union, NJ (US); Robert Rhinesmith, Somerset, NJ (US); Clifford Spitser, Fanwood, NJ (US); Matthew F. Falbo, Lake Geneva, WI (US); David S. Reed, Mukwonago, WI (US)

(73) Assignee: Colgate-Palmolive Company, New York, NY (US)

( * ) Notice: Subject to any disclaimer, the term of this patent is extended or adjusted under 35 U.S.C. 154(b) by 319 days.

(21) Appl. No.: 10/819,325

(22) Filed: Apr. 6, 2004

(65) Prior Publication Data

US 2005/0224515 A1 Oct. 13, 2005

(51) Int. Cl.

| | |
|---|---|
| ***B65D 25/08*** | (2006.01) |
| ***B65D 88/54*** | (2006.01) |
| ***B65D 88/26*** | (2006.01) |
| ***B67D 5/00*** | (2006.01) |
| ***B67D 5/60*** | (2006.01) |

(52) U.S. Cl. ..... 222/82; 222/130; 222/325; 222/460; 222/129; 206/222

(58) Field of Classification Search ..... 222/82, 222/83, 325, 83.5, 88, 130, 385, 460; 206/222, 206/568; 141/330

See application file for complete search history.

(56) References Cited

U.S. PATENT DOCUMENTS

| | | | | |
|---|---|---|---|---|
| 3,378,168 A * | 4/1968 | Hildebrandt | ..... | 222/83 |
| 3,655,096 A | 4/1972 | Easter | | |
| 3,966,089 A | 6/1976 | Klingaman | | |
| 4,088,246 A | 5/1978 | Klingaman | | |
| 4,201,316 A | 5/1980 | Klingaman | | |
| 4,315,570 A | 2/1982 | Silver et al. | | |
| 4,591,050 A | 5/1986 | Finke et al. | | |

(Continued)

FOREIGN PATENT DOCUMENTS

| | | |
|---|---|---|
| BE | 536023 | 3/1955 |

(Continued)

*Primary Examiner*—Kevin Shaver
*Assistant Examiner*—Melvin A. Cartagena
(74) *Attorney, Agent, or Firm*—Michael J. Wallace

(57) ABSTRACT

A cartridge for use in conjunction with a container to dispense a liquid in the cartridge into the container. The cartridge is comprised of a hollow body defined by an enclosing wall that has a closure at an upper end and a lower cartridge wall that is integral to the hollow body, but of a thickness less than that of the hollow body enclosing wall. The lower cartridge wall of a reduced thickness is in a narrowed section of the hollow body. A closure is sealed onto an upper part of the hollow body and has a funnel-like shape with a lower funnel wall. The funnel wall is of a reduced thickness as compared to the remainder of the closure. A flange on the hollow body rests on a container upper surface to support the cartridge on the container. A container closure will hold the cartridge in place during use. A dispensing pump on the container closure has a dip tube which pierces the funnel wall and cartridge wall and thereby dispense the cartridge contents into the container. The cartridge usually remains held onto the container until the contents of the container are depleted. The container will contain a diluent liquid for diluting the cartridge contents to the use concentration.

20 Claims, 5 Drawing Sheets

U.S. PATENT DOCUMENTS

| | | | | |
|---|---|---|---|---|
| 4,615,437 | A | 10/1986 | Finke et al. | |
| 4,793,475 | A | 12/1988 | Itzel | |
| 4,821,923 | A | 4/1989 | Skorka | |
| 4,903,865 | A | 2/1990 | Janowitz | |
| 5,419,445 | A | 5/1995 | Kaesemeyer | |
| 5,421,483 | A | 6/1995 | Parise | |
| 5,542,528 | A | 8/1996 | Lanfranconi et al. | |
| 5,657,910 | A * | 8/1997 | Keyser | 222/382 |
| 5,772,017 | A | 6/1998 | Kang | |
| 5,836,479 | A | 11/1998 | Klima et al. | |
| 5,839,573 | A | 11/1998 | Morini | |
| 5,845,814 | A | 12/1998 | Nobbio | |
| 5,863,126 | A | 1/1999 | Guild | |
| 6,003,728 | A | 12/1999 | Elliott | |
| 6,041,969 | A | 3/2000 | Parise | |
| 6,155,459 | A | 12/2000 | Bunschoten et al. | |
| 6,182,865 | B1 | 2/2001 | Bunschoten et al. | |
| 6,257,428 | B1 | 7/2001 | Caola | |
| 6,290,100 | B1 | 9/2001 | Yacko et al. | |
| 6,302,268 | B1 | 10/2001 | Michaeli | |
| 6,305,576 | B1 * | 10/2001 | Leoncavallo | 222/83.5 |
| 6,364,103 | B1 * | 4/2002 | Sergio et al. | 206/222 |
| 6,474,861 | B1 | 11/2002 | De Laforcade | |
| 2002/0100769 | A1 | 8/2002 | McKune | |

FOREIGN PATENT DOCUMENTS

| | | | |
|---|---|---|---|
| DE | 3535986 | A1 | 4/1987 |
| EP | 0867381 | A1 | 3/1997 |
| EP | 19621774 | | 12/1997 |
| EP | 1012068 | B1 | 11/2002 |
| GB | 1 258 845 | | 12/1971 |
| GB | 2 344 580 | | 6/2000 |
| IT | 1188018 | | 8/1985 |
| IT | 207355 | | 1/1986 |
| IT | VI92A000192 | | 9/1992 |
| IT | VI97A000091 | | 9/1997 |
| JP | 03 270754 | | 12/1991 |
| JP | 3-270754 | | 12/1991 |
| JP | 10 139075 | | 5/1998 |
| WO | WO 98/43895 | | 8/1985 |

* cited by examiner

PUMP DISPENSER AND CARTRIDGE

This invention relates to a cartridge for a pump dispenser and a pump dispenser containing this cartridge.

BACKGROUND OF THE INVENTION

It is common for product containers with pump dispensers, such as trigger pump dispensers, to have the product in the dilution needed for use. The diluent usually is water. The disadvantage of this type of a container and its use is that a large volume of water must be shipped with each product container. This is the case even though the customer has ready access to water at a very low cost. That is, there is ready access to a municipal water supply. The customer could easily supply one component at a low cost.

This problem has been addressed by others. A solution is to use a cartridge which contains a concentrate of the primary ingredient of the product in conjunction with the container. In such a use the customer will fill the container to a given level with a diluent such as water. The cartridge is placed into the neck of the container and upon the placement and attachment of the pump dispenser to the container the cartridge is activated to flow the concentrate down into the diluent. The now sealed container can be shaken to mix the concentrate and diluent. Since pump dispensers have dip tubes which extend to adjacent the bottom of the container the diluted product is dispensed upon actuation of the pump. In this system there is no need to provide a new container with each unit of product. Only a small cartridge needs to be provided. All that needs to be shipped and stored are relatively small cartridges. This results in obvious savings.

The prior art in this area is exemplified by U.S. Pat. No. 3,655,096 and Japanese Patent Application No. 2-69775. Each of these patents discloses a cartridge in an upper part of a bottle where the dip tube of a trigger pump will activate the cartridge by piercing through planar upper portion and in Japanese Application No. 2-69775 through a weakened lower surface. Other cartridge units are disclosed in Italian Patent Application U197A000031; Italian Industrial Model 207355; Italian Patent 1 188 018; PCT WO 98/43895; U.S. Pat. No. 3,966,089; U.S. Pat. No. 5,421,483 and U.S. Pat. No. 6,014969. These latter other cartridge units have a central channel through which the dip tube passes. The dip tube or a part of the central channel will remove a plug at the bottom of the cartridge to release a concentrated liquid into the diluent in the container, usually water. However none of these patents disclose or suggest the structure of the present cartridge. They do not show any way to solve the problem of spillage or back splashing when the dip tube of the pump is pierced through the upper wall of the cartridge. This problem which does not exist for cartridges with a center channel is solved by the present cartridge. The upper wall is of a particular design and preferably both the upper and lower walls have a reduced thickness relative to other parts of the cartridge.

BRIEF DESCRIPTION OF THE INVENTION

The invention comprises a cartridge for containing a substance for dispensing into a container, and the combination of the container and the cartridge. The cartridge comprises an elongated hollow body having an upper end and a lower end. The upper end is closed by an upper closure and the lower end by a lower cartridge wall that is integral with enclosing sidewalls of the hollow body, but of a thickness less than that of the sidewalls of the hollow body. The upper closure preferably has a funnel-like shape with a wall at the base opening of the funnel. This funnel wall is of a thickness of less than that of the remainder of the upper closure. The cartridge also has a flange at an upper end to support the cartridge on a container.

The lower cartridge wall will have an average thickness of about 1% to about 30% of the thickness of the hollow body enclosing sidewalls, and preferably about 3% to 25%. The lower cartridge wall will have a thickness of about 0.0075 mm to about 0.2 mm, and preferably about 0.01 mm to about 0.1 mm. The funnel wall at the base of the upper closure will have a thickness of about the same as the lower cartridge wall. Each of these walls must be pierced by the dip tube.

In use the flange of the cartridge is placed onto a ledge in an upper part of a container. The container closure is attached onto the container to secure the cartridge. The container closure has an associated pump with a dip tube. The dip tube is positioned to pass through the funnel wall at the base of the funnel-like shape of the upper closure and through the lower cartridge wall. Once the lower cartridge wall is pierced the contents of the cartridge will flow into diluent in the container. The container can then be shaken to mix the cartridge contents with the diluent. Upon the activation of the dispenser this solution can be applied to a surface.

The cartridge hollow body preferably is made by thermoforming as is the upper closure. Other molding techniques could be used but they are not as cost effective. The hollow body can be made of polyethylene, polypropylene, polyvinyl chloride or polyethylene terephthalate.

DETAILED DESCRIPTION OF THE DRAWINGS

The present invention is directed to a cartridge for dispensing a concentrated product into a container and the combination of this cartridge with a container. The invention will be described in its preferred embodiments with reference to the drawings.

Figure 1:
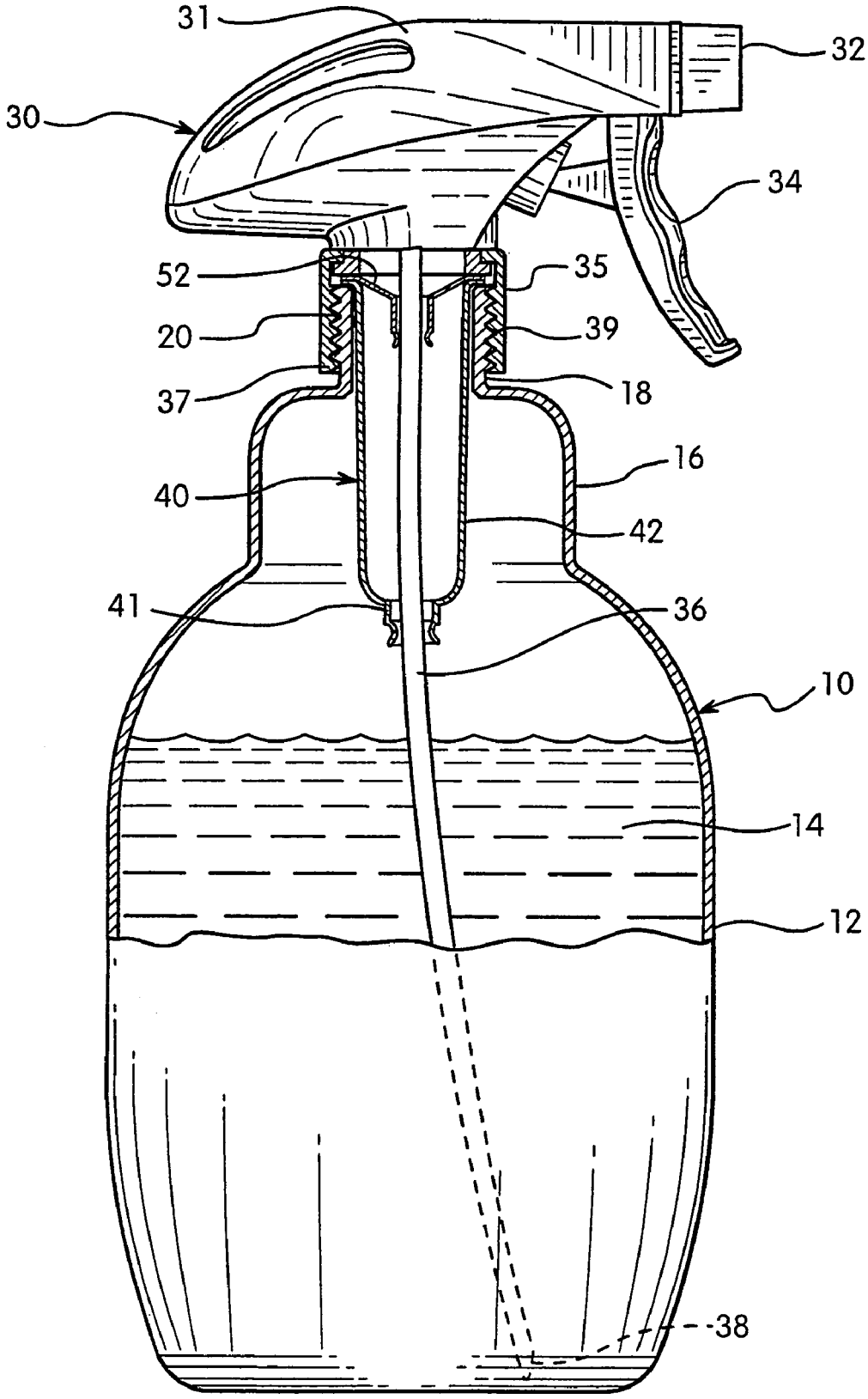
FIG. 1 is an elevation view partially in section of a container and an activated cartridge.

FIG. 1 shows a container 10, cartridge 40 and a trigger pump dispenser 30. The cartridge and container are shown with the cartridge activated. The container 10 is comprised of a body 12 containing a diluent and cartridge product 14. The container has a shoulder 16 and a cylindrical exit 18. This cylindrical exit 18 has threaded section 20. Covering this cylindrical exit 18 is cap 35 with threads 37. The dip tube has angled end surface 38. This preferably is a minimal angle. The threads 37 of the cap mate with threads 39 on threaded section 20.

The cartridge is comprised of elongated hollow body 42 with a narrowed section 41. Here the cartridge is shown as open at the bottom. At the upper end there is closure 52. The pump 30 has a pump head 31, nozzle 32, activator 34 and dip tube 36. The dip tube has pierced and passed through the cartridge with the liquid in the cartridge 40 having passed into the diluent.

Figures 2, 3:
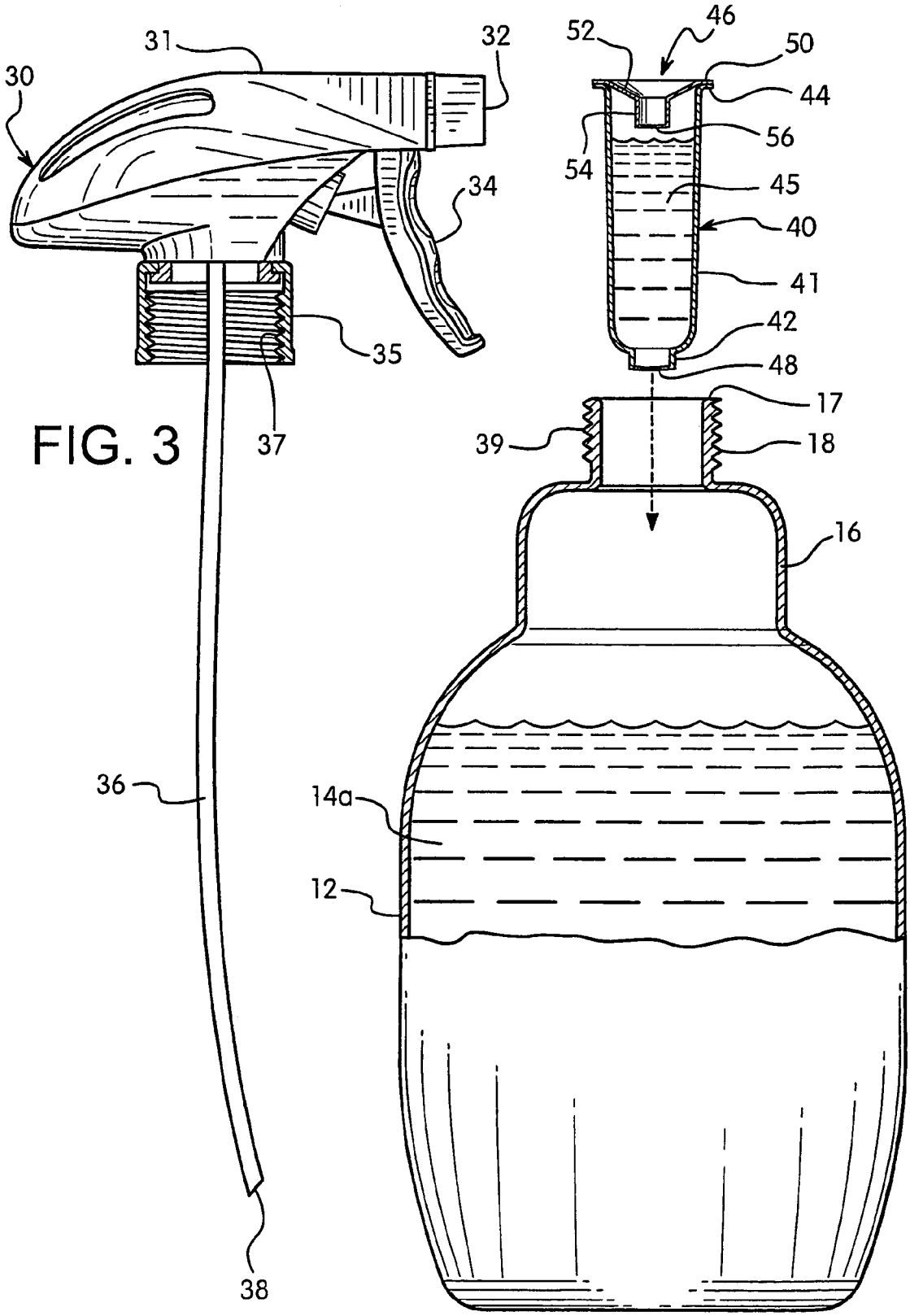
FIG. 2 is an elevation view of partially in section of a container with the cartridge being inserted.
FIG. 3 is an elevation view of a trigger pump dispenser with the attaching closure in section.

FIG. 2 shows the cartridge 40 and container 10 in an exploded view. The container body 12 contains a diluent liquid 14(*a*). The cartridge fits down into the upper part of the container 16 has a flange 44 which rests on top surface 17 of the cylindrical exit 18. The cartridge 40 is comprised of enclosing wall 42 and narrowed section 41 with lower cartridge wall 48. Contained in the cartridge is concentrated product 45. The upper part of the cartridge has closure 46 which has a sloping funnel-like shape 52. This has a narrowed section 54 and a closure wall 56. The cartridge flange 44 is overlayed by flange 50 of the closure. Typically the closure 46 is sealed into place after the cartridge is filled.

FIG. 3 shows the trigger pump with dip tube 36 and its open end 38. The threads 37 which mate with threads 39 are shown more clearly in this view.

Figure 4:
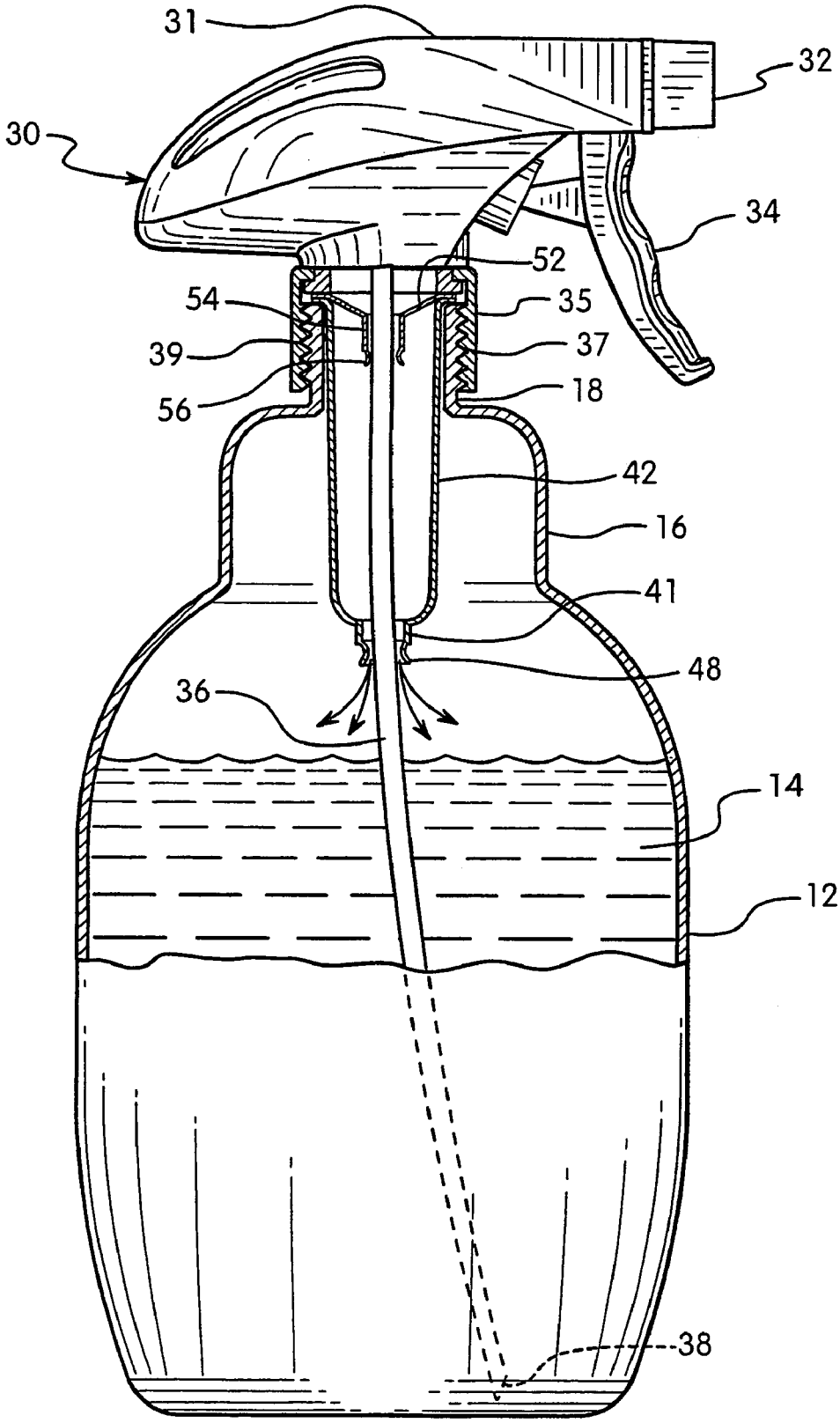
FIG. 4 is an elevation view of a container and cartridge with the cartridge just activated.

FIG. 4 shows the dip tube 36 of trigger pump 30 passed through the cartridge. The dip tube end 38 pierced through funnel wall 56 of closure 52 and cartridge wall 48 of the narrowed section 41. Once the concentrate 45 is in the diluent 14(*a*) the container is shaken and the container is ready for use.

Figure 5:
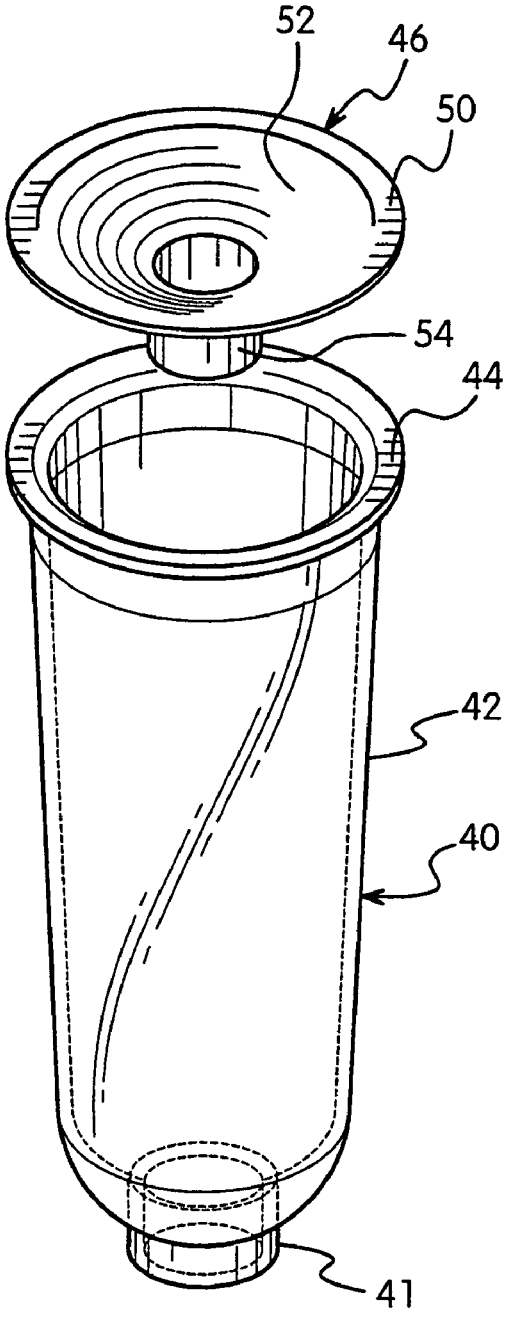
FIG. 5 is a perspective view of a cartridge.
Figure 6:
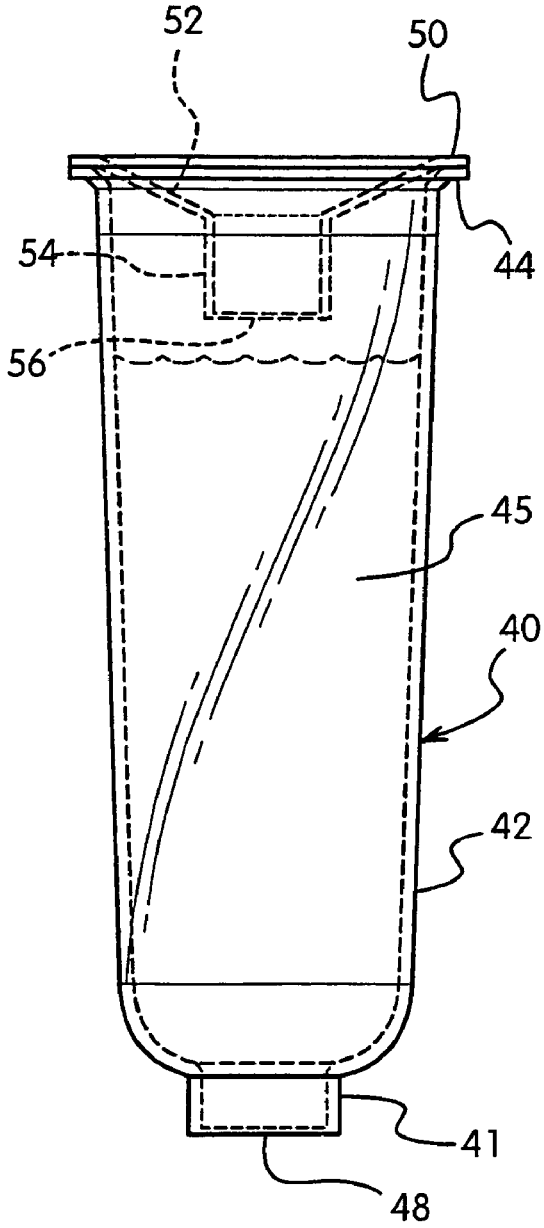
FIG. 6 is a side elevation view of a cartridge.

FIG. 5 shows the cartridge 40 with the closure 46 removed. The cartridge is filled in this condition. The concentrated liquid 45 is placed in the cartridge as shown in FIG. 6 and flange 50 sealed into flange 44 by heat, adhesive, or equivalent means of sealing. Surface 52 and narrowed section 54 form a funnel-like shape to the closure. This funnel-like shape will guide dip tube 36 into narrowed section 54 to pierce funnel wall 56.

FIG. 6 shows the cartridge 40 filled with concentrate 45 and sealed. This cartridge can be packaged and shipped to the point of use. At the point of use it is inserted into a container containing a diluent and activated by a pump dispenser with a dip tube.

Figure 7:
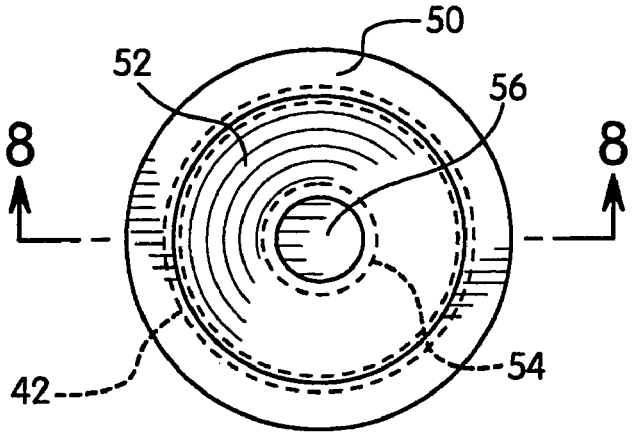
FIG. 7 is a top plan view of a cartridge.
Figure 9:
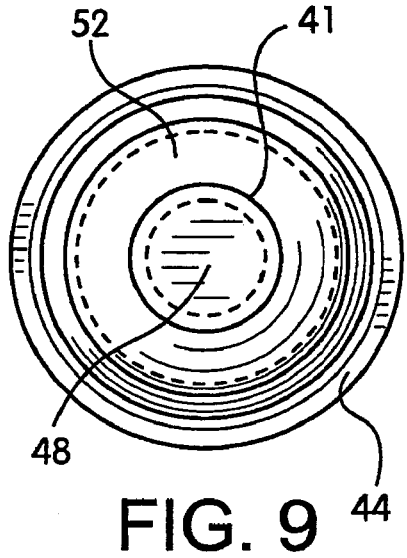
FIG. 9 is a bottom plan view of a cartridge.
Figure 8:
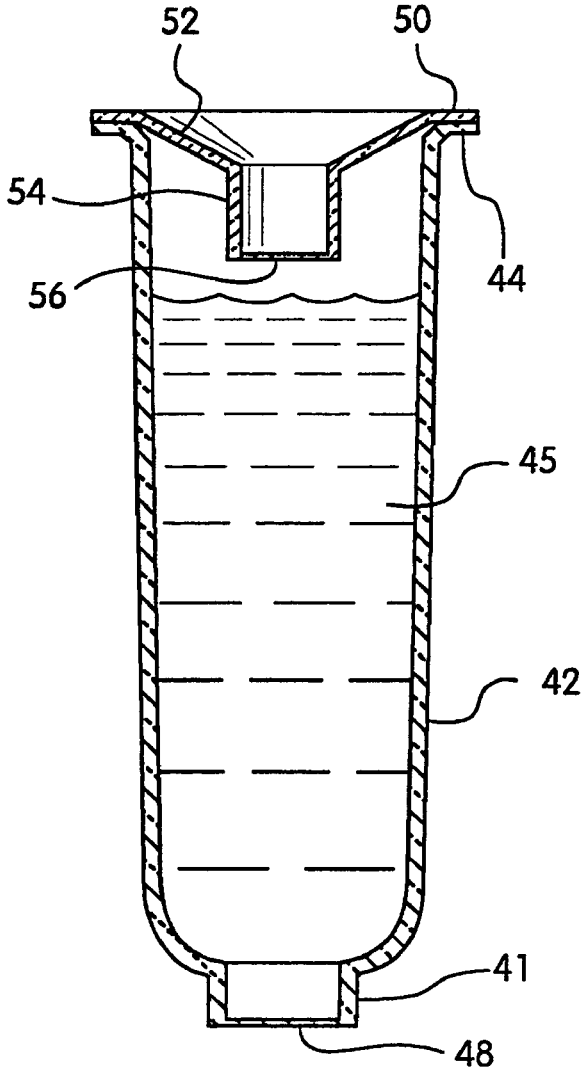
FIG. 8 is a side elevation view in cross-section of a cartridge.

FIG. 7 is a top plan view of the cartridge and FIG. 9 a bottom plan view. FIG. 8 is a side elevation view of the cartridge in section. These views serve to further illustrate the invention.

The cartridge lower wall 48 of the narrowed section 41 will have a thickness less than that of the hollow body enclosing wall 42. This is a thickness of substantially less than the hollow body enclosing wall. In addition this cartridge wall 48 is of a substantially uniform thickness. This is to facilitate the puncture of this wall by angled end 38 of dip tube 36. The cartridge lower wall 48 will have an average thickness of about 0.0075 mm to about 0.2 mm and preferably about 0.01 mm to about 0.1 mm. The cartridge lower wall 48 will have a thickness of about 1% to about 30%, and preferably 3% to about 25% of that of the hollow body. The exact thickness will depend to a degree on the material being used to make the hollow body. The funnel wall 56 of the closure is usually about the same thickness as wall cartridge lower wall 48. The hollow body enclosing wall 42 has an average thickness of about 0.05 mm to about 4.0 mm, and preferably about 0.1 mm to about 2 mm. The average sidewall thickness is the average of measurements at the middle and of each end of the sidewall.

The cartridge lower wall and the funnel wall are of a thickness that can be penetrated by the dip tube. The dip tube is inserted down through the funnel wall 56 and the cartridge lower wall 48. The dip tube must be able to penetrate these walls 48,56 without undue force or any damage to the dip tube.

In use a diluent 14(*a*) such as water is added to container 10. A cartridge 40 then is placed in the container with surface 17 of the container exit supporting the flange 44 of the cartridge. Flange 50 of the closure 46 reinforces flange 44 as well as sealing the cartridge. These two flanges will have a combined thickness of about 0.005 mm to about 0.1 mm and preferably about 0.01 mm to about 0.07 mm. The dip tube 36 with (preferably minimal) angled end 38 then is passed through funnel wall 56 and wall 48 to dispense the concentrate 45 into the diluent 14(*a*). The container is then shaken to mix the concentrated liquid 45 with the diluent 14(*a*). This produces a useable product 14. This useable product usually a cleanser is dispensed onto a surface by means of trigger pump 30.

The container 10 can be blow molded out of any thermoplastic such as polyethylene, polypropylene, polyvinyl chloride or polyethylene terephthalate. The trigger pump 30 can be any commercially available trigger pump, but it should have an (preferably minimal) angled end 38 to the dip tube 36 to better pierce funnel wall 56 and cartridge wall 48. The cartridge 40 can be made by various techniques with thermoforming preferred for the cartridge hollow body 42 and thermoforming for closure 46 of the cartridge. The closure preferably will be heat sealed to the hollow body.

The invention has been described in its preferred embodiments. However there are many equivalent structures to the present cartridges.

What is claimed is:

1. A cartridge for containing a liquid to be dispensed into a reservoir comprising an elongated hollow body having an enclosing wall, an upper end and a lower end, the upper end having an outwardly extending flange and closed by a closure and the lower end closed by an integral lower cartridge wall of a thickness less than that of the enclosing wall, the closure sealed to the hollow body at an upper end of said hollow body, the closure having (i) a funnel-like shape and a lower funnel wall having a thickness of less than about the thickness of the enclosing wall; and (ii) a peripheral flange which overlays the flange on the upper end of the cartridge.

2. A cartridge as in claim 1 wherein the hollow body at the lower end has a narrowed section, the lower cartridge wall at the end of the narrowed section.

3. A cartridge as in claim 2 wherein the hollow body narrowed section has a cylindrical shape.

4. A cartridge as in claim 1 wherein the lower cartridge wall has an average thickness of about 1% to about 30% of said enclosing wall.

5. A cartridge as in claim 4 wherein said lower cartridge wall has an average thickness of about 0.0075 mm to about 0.2 mm and said enclosing wall has an average thickness of about 0.05 mm to about 4.0 mm.

6. A container and combined cartridge, the cartridge for containing and dispensing a liquid into the container comprising the container with the cartridge mounted on an upper portion of the container, the cartridge comprising an elongated hollow body having an enclosing wall, an upper end and a lower end, the upper end having an outwardly extending flange and closed by a closure and the lower end closed by an integral lower cartridge wall of a substantially constant thickness less than the thickness of the enclosing wall, the closure sealed to the hollow body at an upper end of said hollow body, the closure having (i) a funnel-like shape and a lower funnel wall less than about the thickness of the enclosing wall, and (ii) a peripheral flange with the hollow body outwardly extending flange and the peripheral flange being sealed together to seal the cartridge.

7. A combined container and cartridge as in claim 6 wherein the hollow body at the lower end has a narrowed section, the lower cartridge wall at the end of the narrowed section.

8. A combined container and cartridge as in claim 7 wherein the narrowed section has a cylindrical shape.

9. A combined container and cartridge as in claim 8 wherein the lower cartridge wall has a thickness of about 1% to about 30% of said enclosing wall.

10. A combined container and cartridge as in claim 9 wherein said lower cartridge wall has a thickness of about 0.0075 mm to about 0.2 mm and said enclosing wall has a thickness of about 0.05 mm to about 4.0 mm.

11. A combined container and cartridge as in claim 6 wherein the hollow body outwardly extending flange on the upper end thereof contacts an upper part of the container whereby said hollow body can be supported on the upper part of the container.

12. A cartridge for containing a liquid to be dispensed into a reservoir comprising an elongated hollow body having an enclosing wall, an upper end and a lower end, the upper end having an outwardly extending flange and closed by a closure and the lower end closed by an integral lower cartridge wall of a thickness less than that of the enclosing wall, the closure sealed to the hollow body at an upper end of said hollow body, the closure having (i) a funnel-like shape and a lower funnel wall having a thickness of less than about the thickness of the enclosing wall; and (ii) a closure narrowed section which extends down into the hollow body, the lower funnel wall being at the lower end of the closure narrowed section.

13. A cartridge as in claim 12 wherein said closure narrowed section has a cylindrical shape.

14. A cartridge as in claim 12 wherein the hollow body at the lower end has a narrowed section, the lower cartridge wall at the end of the narrowed section.

15. A cartridge as in claim 14 wherein the hollow body narrowed section has a cylindrical shape.

16. A cartridge as in claim 12 wherein the lower cartridge wall has an average thickness of about 1% to about 30% of said enclosing wall.

17. A container and combined cartridge, the cartridge for containing and dispensing a liquid into the container comprising the container with the cartridge mounted on an upper portion of the container, the cartridge comprising an elongated hollow body having an enclosing wall, an upper end and a lower end, the upper end having an outwardly extending flange and closed by a closure and the lower end closed by an integral lower cartridge wall of a substantially constant thickness less than the thickness of the enclosing wall, the closure sealed to the hollow body at an upper end of said hollow body, the closure having (i) a funnel-like shape and a lower funnel wall less than about the thickness of the enclosing wall; and (ii) a closure narrowed section which extends down into the hollow body, the lower funnel wall at the lower end of the of the closure narrowed section.

18. A combined container and cartridge as in claim 17 wherein the hollow body at the lower end has a narrowed section, the lower cartridge wall at the end of the narrowed section.

19. A combined container and cartridge as in claim 18 wherein the narrowed section has a cylindrical shape.

20. A combined container and cartridge as in claim 18 wherein the lower cartridge wall has a thickness of about 1% to about 30% of said enclosing wall.

* * * * *